US007434721B2

(12) United States Patent
Feltz

(10) Patent No.: US 7,434,721 B2
(45) Date of Patent: Oct. 14, 2008

(54) POLYGONAL COLLAPSIBLE BULK BIN

(75) Inventor: Michael Duane Feltz, Mishawaka, IN (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 565 days.

(21) Appl. No.: 10/877,405

(22) Filed: Jun. 25, 2004

(65) Prior Publication Data

US 2005/0284922 A1 Dec. 29, 2005

(51) Int. Cl.
*B65D 5/10* (2006.01)
*B65D 5/36* (2006.01)

(52) U.S. Cl. ..... 229/109; 229/157; 229/185

(58) Field of Classification Search ..... 229/101, 229/108.1, 109, 117.06, 199, 156, 138, 157, 229/184; 493/89
See application file for complete search history.

(56) References Cited

U.S. PATENT DOCUMENTS 634,645 A * 10/1899 Knobeloch ..... 229/138
3,907,194 A * 9/1975 Davenport et al. ..... 229/109
4,361,267 A * 11/1982 Wozniacki ..... 229/109
4,386,729 A * 6/1983 Schmidt ..... 229/109
4,502,624 A * 3/1985 Burrell ..... 229/109
4,702,408 A * 10/1987 Powlenko ..... 229/101
4,850,506 A * 7/1989 Heaps et al. ..... 229/117.3
5,628,450 A * 5/1997 Cromwell et al. ..... 229/109
6,588,651 B2 * 7/2003 Quaintance ..... 229/109
6,783,058 B2 * 8/2004 Quaintance ..... 229/109
7,094,194 B2 * 8/2006 Barner ..... 493/89
2002/0096559 A1 * 7/2002 Quaintance ..... 229/109
2004/0031842 A1 * 2/2004 Westerman et al. .... 229/117.06
2005/0184138 A1 * 8/2005 Barner ..... 229/199
2006/0273145 A1 * 12/2006 Barner ..... 229/199

* cited by examiner

*Primary Examiner*—Nathan J Newhouse
*Assistant Examiner*—Christopher Demeree
(74) *Attorney, Agent, or Firm*—Armstrong Teasdale LLP

(57) ABSTRACT

A collapsible bulk bin, formed from a sheet that is folded upon itself to form a tube, having a plurality of bottom panels pivotably connected to respective side walls of the bulk bin. A plurality of connector panels foldably connect adjacent ones of the bottom panels, to provide a slotless bottom configuration to provide reinforcing strength to the bottom, and bottom regions of the side walls of the bulk bin.

18 Claims, 10 Drawing Sheets

POLYGONAL COLLAPSIBLE BULK BIN

BACKGROUND OF THE DISCLOSURE

1. Field of the Invention

The present invention relates in general to cartons fabricated from paper, paperboard and/or corrugated paperboard material, particularly collapsible bulk bin containers.

2. Background Art

Bulk bins fabricated from paperboard, particularly corrugated paperboard are known. Many of these bulk bins are fabricated so that they may be collapsed after use, shipped back to their original loading point, and re-used.

A typical collapsible bulk bin construction will be a bin that has eight side walls, four "long" side walls, and four "short" side walls, disposed in alternating fashion along a blank. Usually, one of the "short" side walls will be formed from two "half" panels, located at the ends of the blank, each of which has a width which is greater than one-half the width of a "short" side wall. Bottom closure flaps, which are die cut separate from one another, emanate from the bottom edges of each of the panels that form the long and short side walls. Each of the bottom closure flaps typically has a width corresponding to its respective side wall panels. To form the bulk bin, the blank will be turned upon itself so that the free edges of the long side wall halves overlap. These panels will be affixed to one another, e.g., by staples or adhesive, so that the folded blank has formed a tube. The bottom closure flaps are folded inwardly to overlap one another and form the bottom of the bin. The bin may be placed on a pallet or slip sheet for transportation purposes.

Although some of these bins can be quite strong, it has been a challenge in the industry to provide a collapsible bulk bin which is capable of holding a load in excess of 2000 pounds. Such prior art bins may be susceptible to failure, which is believed to be caused by the presence of the slots and gaps that are formed in the bottom, as a result of the use of the separately emanating overlapping bottom flaps. Therefore, in order to support such loads, the bulk bins may have to be provided with additional support, in the form of external bands, which may be fabricated from metal or plastic material, which add to the cost of the bin, and which complicate its use.

Accordingly, it would be desirable to provide a collapsible bulk bin which is capable of withstanding heavy loading with reduced likelihood of failure, and without requiring the addition of further structural support, such as external banding.

These and other desirable characteristics of the invention will become apparent in view of the present specification, claims and drawings.

SUMMARY OF THE INVENTION

The present invention comprises, in part, a collapsible bulk bin, fabricated from a foldable material, which comprises a plurality of side walls, arranged in the form of a tube and connected to one another along a plurality of parallel-extending fold lines. A plurality of bottom panels extends from bottom edge regions of the side walls, with a fold line disposed between each bottom panel and its respective side wall. Each bottom panel is pivotable between an unfolded position substantially parallel to its corresponding side wall, and a folded position substantially perpendicular to its corresponding side wall. A plurality of connector panels is provided, in which each connector panel is disposed between and emanating, along lines of weakness, from side edge regions of adjacent ones of the plurality of bottom panels. Each connector panel is pivotable between an unfolded position disposed substantially parallel to and coplanar with one of its corresponding adjacent bottom panels, to a folded position disposed in sandwiched orientation between its adjacent bottom panels. Each connector panel is further operably configured such that upon folding of one of its adjacent bottom panels from its unfolded position to its folded position, the connector panel prompts the other of the adjacent bottom panels from its unfolded position to its folded position. The connector panels provide slotless interconnections between adjacent bottom panels, the slotless interconnections extending from lower end regions of the fold lines which extend between adjacent ones of the side walls, so as to bridge gaps, which may otherwise be formed between adjacent ones of the bottom panels, upon articulation of the bottom panels into their folded positions, toward precluding the creation of gaps at corner regions of a bottom area of the collapsible bulk bin which may prompt failure of the collapsible bulk bin, subsequent to loading thereof.

In a preferred embodiment of the invention, each connector panel has a substantially triangular configuration.

The collapsible bulk bin further comprises an aperture disposed in at least one of the bottom panels, operably configured to interlockingly receive a corner of another of the bottom panels, when the bottom panels have been pivoted to their folded positions, for releasably holding the bottom panels in their respective folded positions.

In a preferred embodiment of the invention, the bulk bin has one of four, six or eight side walls.

Preferably, two of the bottom panels, disposed opposite one another on the bulk bin, are substantially rectangular, and the remaining bottom panels are substantially non-rectangular.

The bulk bin is preferably fabricated from at least one of paper, paperboard, corrugated paperboard. The bulk bin is preferably fabricated from a blank formed from a single sheet of foldable material. The collapsible bulk bin may also have a plurality of top reinforcement panels emanating from top edges of the side wall panels, wherein the top reinforcement panels are provided with slots for enabling the top reinforcement panels to be interdigitated, for providing resistance to outward bulging of the side wall panels, when the bulk bin formed from the blank is loaded.

The invention also comprises, in part, a blank for forming a collapsible bulk bin. The blank comprises a substantially rectangular sheet fabricated from a foldable material. A plurality of side wall panels are formed therein and separated from one another by a plurality of parallel-extending lines of weakness, the side wall panels disposed at opposite ends of the sheet having free edges. A plurality of bottom panels extend from bottom edge regions of the side wall panels, with a fold line disposed between each bottom panel and its respective side wall panel, the bottom panels disposed at opposite ends of the sheet having free edges. Connector panels are disposed between and emanating, along lines of weakness, from side edge regions of adjacent ones of the plurality of bottom panels. The side wall panels disposed at opposite ends of the sheet are operably configured to be overlapped to form a composite side wall panel, upon folding of the sheet upon itself to form a tube. The bottom panels disposed at opposite ends of the sheet are operably configured to be overlapped to form a composite side wall panel, upon folding of the sheet upon itself to form a tube, the connector panels providing slotless interconnections between adjacent bottom panels, the slotless interconnections extending from lower end regions of the fold lines which extend between adjacent ones of the side walls so as to bridge gaps, which may otherwise be formed between adjacent ones of the bottom panels, upon articulation of the bottom panels into their folded positions, toward precluding the creation of gaps at corner regions of a bottom area of the collapsible bulk bin which may prompt failure of the collapsible bulk bin, subsequent to loading thereof.

In the blank, each connector panel preferably has a substantially triangular configuration.

An aperture is disposed in at least one of the bottom panels, for interlockingly receiving a corner of another of the bottom panels, when the blank is articulated into a deployed bulk bin configuration.

Two of the bottom panels are preferably substantially rectangular, and the remaining bottom panels are preferably substantially non-rectangular.

The blank is preferably fabricated from at least one of paper, paperboard, corrugated paperboard. The blank is preferably formed from a single sheet of foldable material. The blank may also have a plurality of top reinforcement panels emanating from top edges of the side wall panels, wherein the top reinforcement panels are provided with slots for enabling the top reinforcement panels to be interdigitated, for providing resistance to outward bulging of the side wall panels, when the bulk bin formed from the blank is loaded.

DETAILED DESCRIPTION OF THE INVENTION

Figure 1:
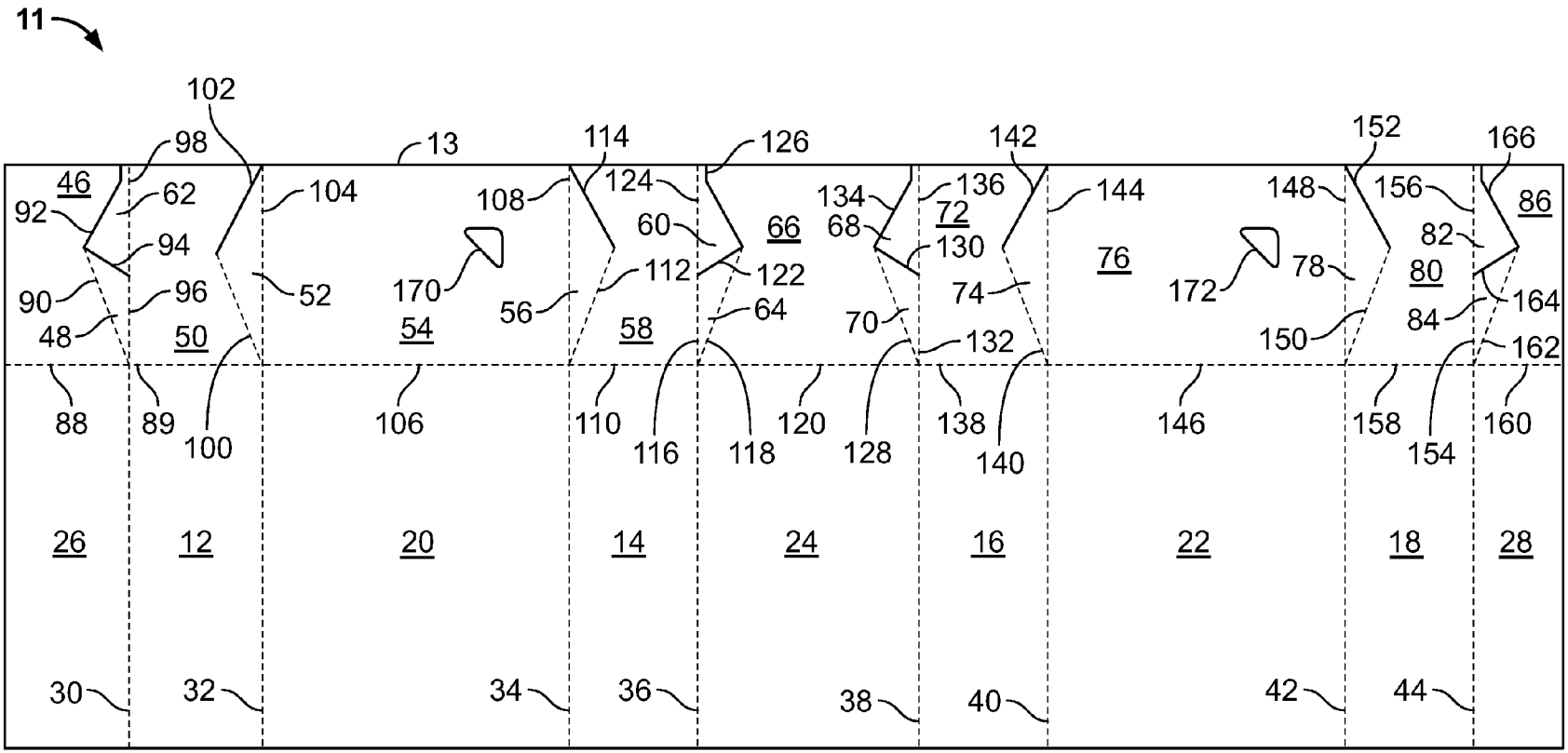
FIG. 1 is a plan view of a blank for forming a collapsible bulk bin according to a preferred embodiment of the invention.

While this invention is susceptible of embodiment in many different forms, there is shown in the drawings and will herein be described in detail, a preferred embodiment with the understanding that the present disclosure should be considered as an exemplification of the principles of the invention and is not intended to limit the invention to the embodiment so illustrated.

The cartons of the present invention are preferably fabricated from paper, paperboard and/or corrugated paperboard, although other materials having similar performance characteristics may be employed, as desired or dictated by the requirements of a particular application.

When referring to the plan illustrations of the blanks, the usual drawing conventions for illustration of carton blanks fabricated from paper, paperboard and/or corrugated paperboard, as are customarily employed in the art, are applied. That is, unless otherwise noted, broken lines on the interior of a blank indicate scores, fold lines or other lines of weakness such as perforations; scalloped lines on the interior of a blank indicate lines of weakness forming a tear strip or similar structure; and solid lines within the interior of, or extending to the edge of, a blank, indicate through-cuts.

Bulk bin 10 is formed from blank 11, shown in plan form (from an "inside" view) in FIG. 1. Blank 11 includes corner panels 12, 14, 16 and 18; "long" side wall panels 20, 22; "short" side wall panel 24; and "half" panels 26, 28; as well as vertical fold lines 30, 32, 34, 36, 40, 42 and 44. The bottom structure for bulk bin 10 includes bottom panels 46, 50, 54, 58, 66, 72, 76, 80 and 86; connector panels 48, 52, 56, 64, 70, 74, 78 and 84; clearance flaps 62, 60, 68 and 82; fold lines 88, 89, 90, 96, 98, 100, 104, 106, 108, 110, 112, 116, 118, 120, 124, 128, 132, 136, 138, 140, 144, 146, 148, 150, 154, 156, 158, 160, 162; die cuts 92, 94, 102, 114, 122, 126, 130, 134, 142, 152, 164, 166; and triangular holes 170, 172.

Bulk bin 10 is of an octagonal configuration, with two sets of parallel side walls, namely "long" side walls 20, 22; "short" side walls 24 and 26/28 and corner side walls 12, 14, 16, and 18. The corresponding respective "long" bottom panels 54 and 76 are rectangular, while "short" bottom panels 66 and 46/86 are hourglass-shaped; while the corner bottom panels 50, 58, 72 and 80 are "K"-shaped. Connector panels, which are disposed between corner bottom panels and the long bottom panels, namely connector panels 52, 56, 74 and 78 are in the form of approximately isosceles triangles, extending to the free edge 13 of the blank, which have one of their short sides defined by a die cut. The connector panels that are disposed between the corner bottom panels and the short bottom panels, namely connector panels 48, 64, 70 and 84 are triangular flaps that do not extend to the free edge 13 of the blank, but are adjacent the clearance flaps.

The clearance panels typically may have shapes that are the same as the connector panels (i.e., triangular). Alternatively, they may be as configured, with rectangular ends (which may prevent fraying). Similarly, the corners of the locking tabs are usually not pointed, also for purposes of inhibiting fraying. In further alternative embodiments of the invention, the clearance flaps may be die cut entirely from the blank, provided that the presses used to cut/print the blanks are capable of physically removing all the cut-away scrap material from the blanks.

Figure 1A:
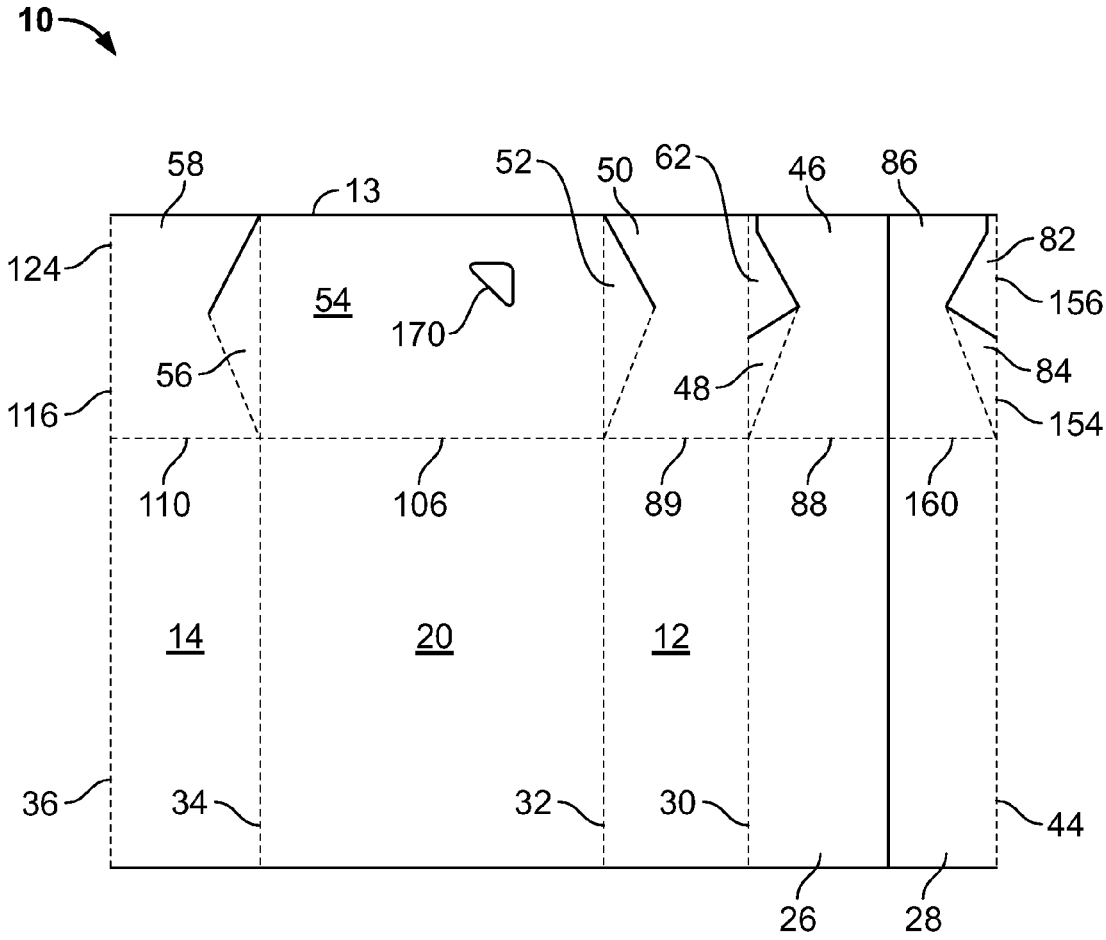
FIG. 1A is a plan view of the bulk bin, in a folded flat configuration, after the blank has been folded upon and joined to itself.
Figure 2:
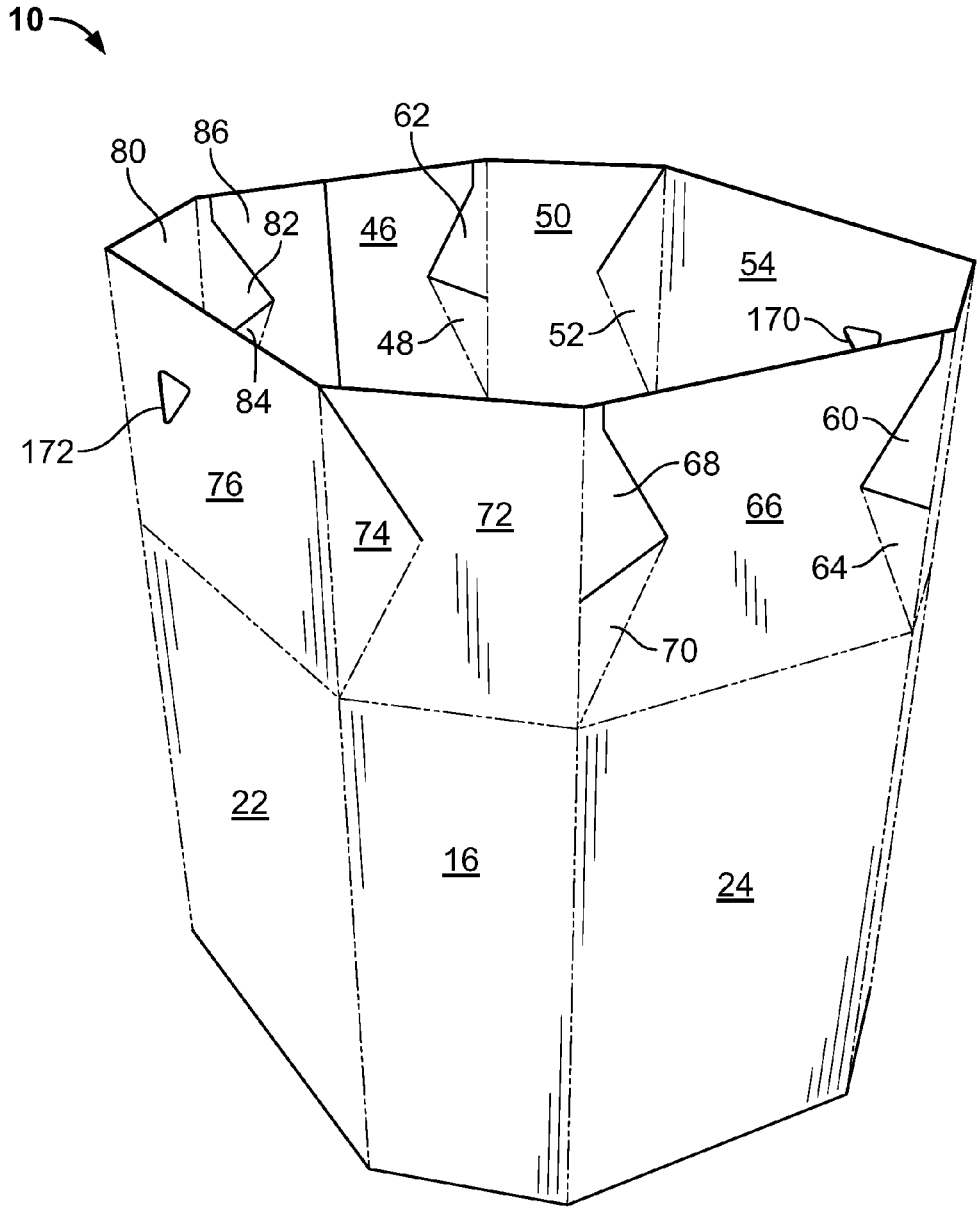
FIG. 2 is perspective view of the bulk bin, according to the present invention, in which the blank has been formed into a tube, with the free ends affixed to one another, but prior to folding of any of the bottom panels.

To form bulk bin 10, first blank 11 is folded into a tubular form, with half panels 26, 28 overlapping so that their combined width is approximately equal to the width of short side wall panel 24. Half panels 26, 28 are then affixed to one another by any suitable method, such as adhesives or staples, or a combination thereof. This stage in the formation process is shown in FIG. 2. In a preferred method of manufacture, the affixation of panels 26 and 28 may be accomplished by first folding blank 11 about fold lines 44, 154 and 156, so that half panel 28 overlies corner panel 18; and bottom panel 86, connector panel 84 and clearance panel 82 overlie bottom panel 80. Then, blank 11 is then folded about fold lines 36, 116 and 124, so that half panel 26 overlies panel 28, and can be affixed thereto. This results in a flattened tubular structure, as shown in FIG. 1A, in which configuration, bulk bin 10 may be readily transported.

Figure 3:
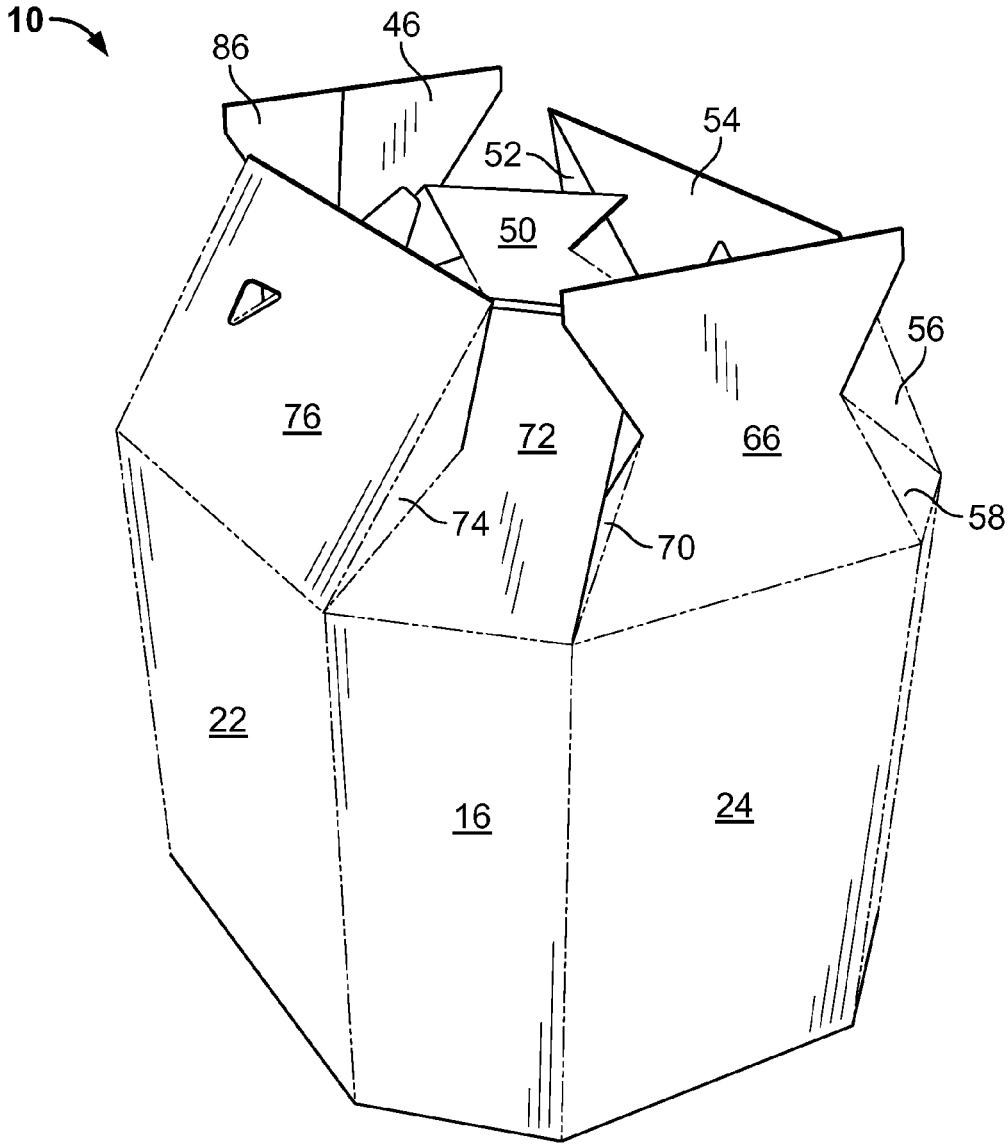
FIG. 3 is a perspective view of the bulk bin, according to the embodiment of FIGS. 1 and 2, with the bottom panels slightly folded.
Figure 4:
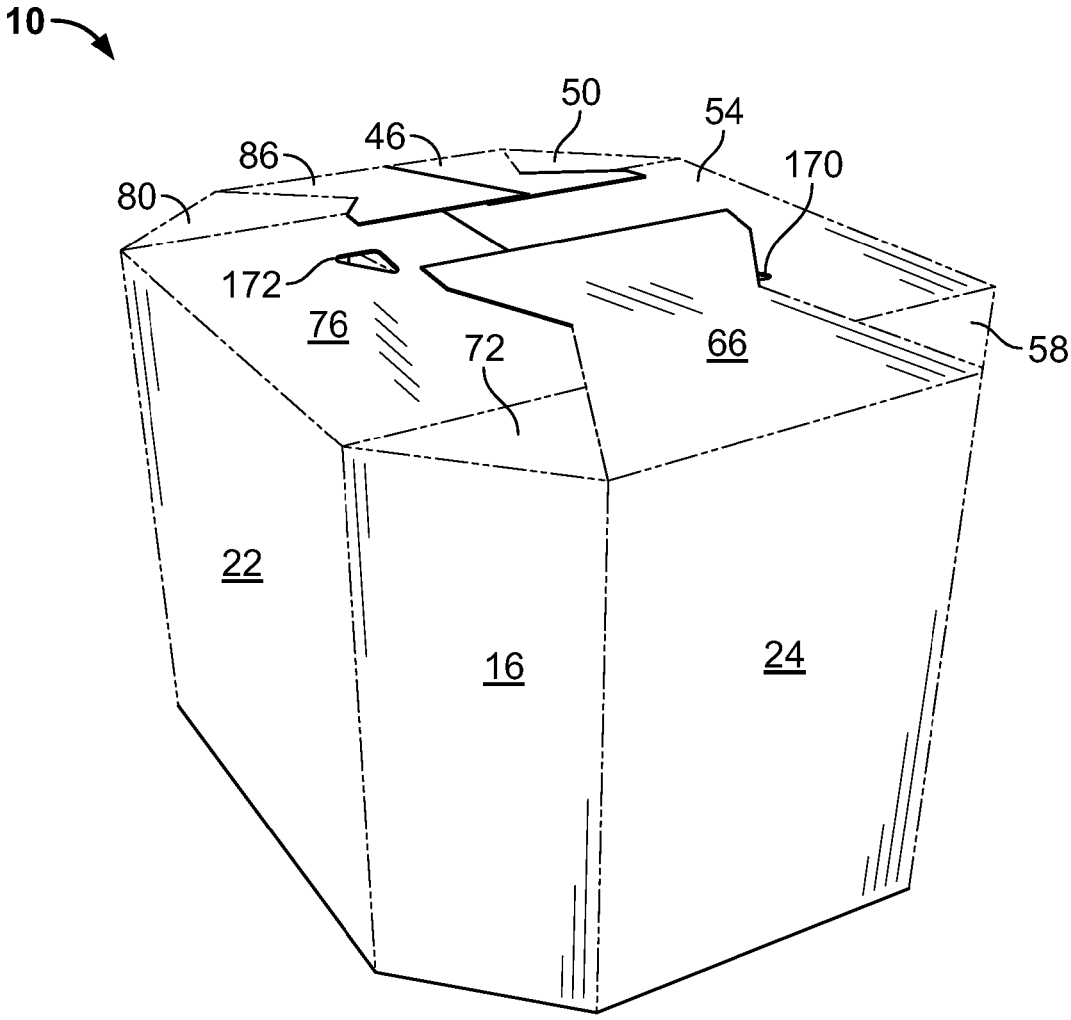
FIG. 4 is a perspective view of the bulk bin, according to the embodiment of FIGS. 1 and 2, with the bottom panels further folded.
Figure 5:
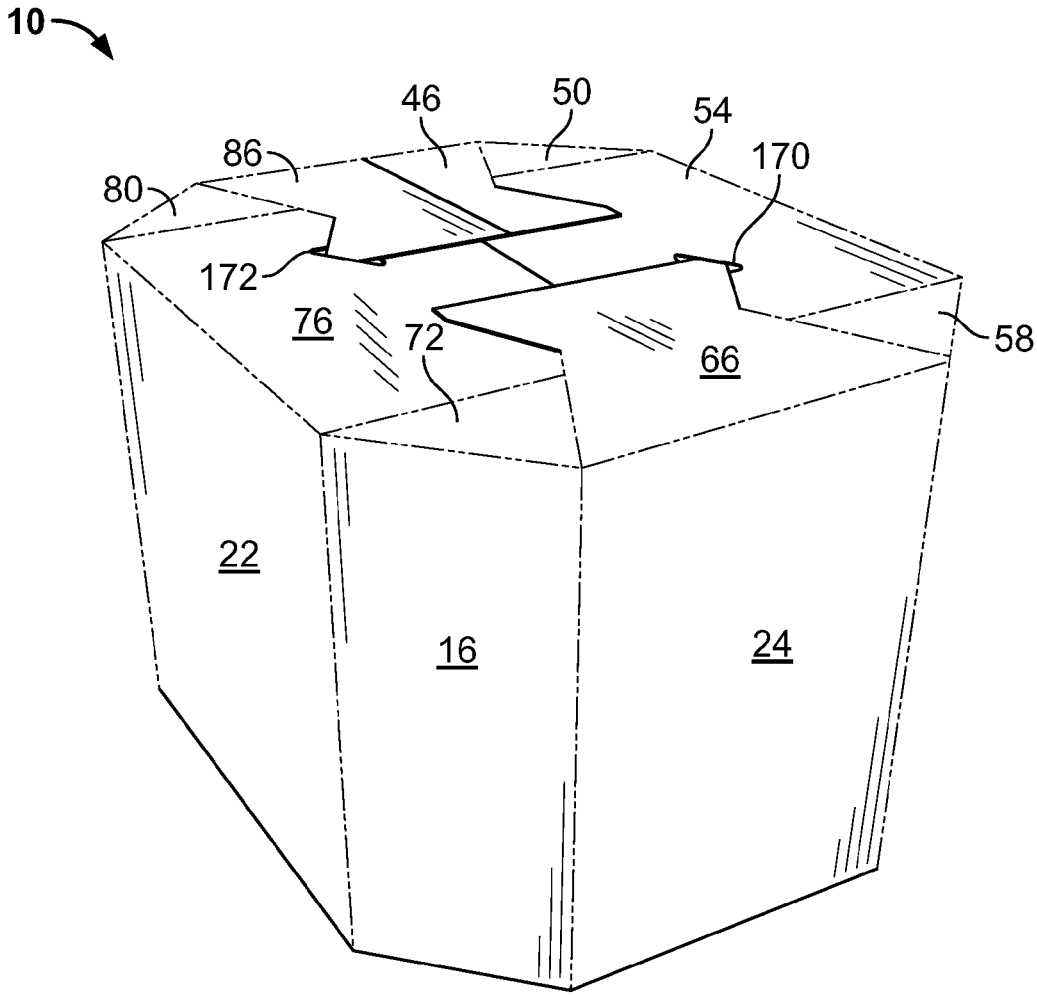
FIG. 5 is a perspective view of the bulk bin, according to the embodiment of FIGS. 1 and 2, with the bottom panels completely folded and tucked.

To form bulk bin 10 into a container, the bin is opened into a tube, as shown in FIG. 2, in which each of bottom panels 46, 50, 54, 58, 66, 72, 76, 80 and 86 are extending straight up from their respective side wall panels 26, 12, 20, 14, 24, 16, 22, 18 and 28. "Corner" bottom panels 50, 58, 72 and 80 are then folded inwardly, about their respective fold lines 89, 110, 138 and 158. As this is done, connector panels 48, 52, 56, 64, 70, 74, 78 and 84 pivot along their respective fold lines 90, 96; 100, 104; 108, 112; 116, 118; 128, 132; 140, 144; 148, 150; and 154, 162, so that the connector panels move toward, and then past, positions that are perpendicular to their respective corner bottom panels, to positions in which they begin to be folded "under" bottom panels 54, 66, and 76 and composite bottom panel 86/46. As corner bottom panels 50, 58, 72 and 80 continue to be folded to positions perpendicular to side wall panels 12, 14, 16 and 18, connector panels 48, 52, 56, 64, 70, 74, 78 and 84 "pull" bottom panels 54, 66, and 76 and composite bottom panel 86/46 down into overlapping positions over the bottom corner panels. FIGS. 3 and 4 illustrate the relative positions of the respective bottom panels, during the folding process. During the folding process, clearance flaps 62, 60, 68 and 82 pivot, as necessary, about their respective fold lines 98, 124, 136 and 156, to enable the edges of the adjacent bottom panels to move past. As the folding process is completed, the free edge of one of bottom panels 54 and 76 will overlap the other.

At the end of the folding process, as bottom panel 66 and composite bottom panel 86/46 approach perpendicularity relative to their respective side wall panels 24 and 26/28, opposing free corners of panels 66 and 86 are tucked into triangular apertures 170 and 172, respectively, to help hold the bottom panels in their folded configurations, both during formation, and after bin 10 is flipped over, and placed, if desired, on a pallet or skid sheet, prior to loading. At the end of the folding process, all of the bottom area of the bin will be closed or covered by one or more of the bottom panels.

Because all of the bottom panels are connected to one another along their peripheral edge regions, in the vicinity of the bottom edges of the side wall panels, there are no slots, and thus no points of weakness which can provide origination points for tears or rips that might lead to failure of the bin when under stress. By interconnecting the bottom panels with the connector panels, it is believed that the overall strength and resistance to bulging, particularly in the area of the side wall panels closest to the bottom of the bin, is enhanced, thereby reducing or eliminating the need for additional external support in the form of circumferentially extending bands or straps.

While in the embodiment of the invention illustrated in FIGS. 1-5, the bulk bin is in the form of an octagonal bin (when viewed from above), it is to be understood that the number of side walls of the bin may be modified, e.g., to a four-sided bin, or other number of side walls, without departing from the scope of the invention, and the principles of the present invention may be readily adapted by one of ordinary skill in the art of bin design, having the present disclosure before them, to bins having greater or fewer side walls than that illustrated in FIGS. 1-5.

Figure 6:
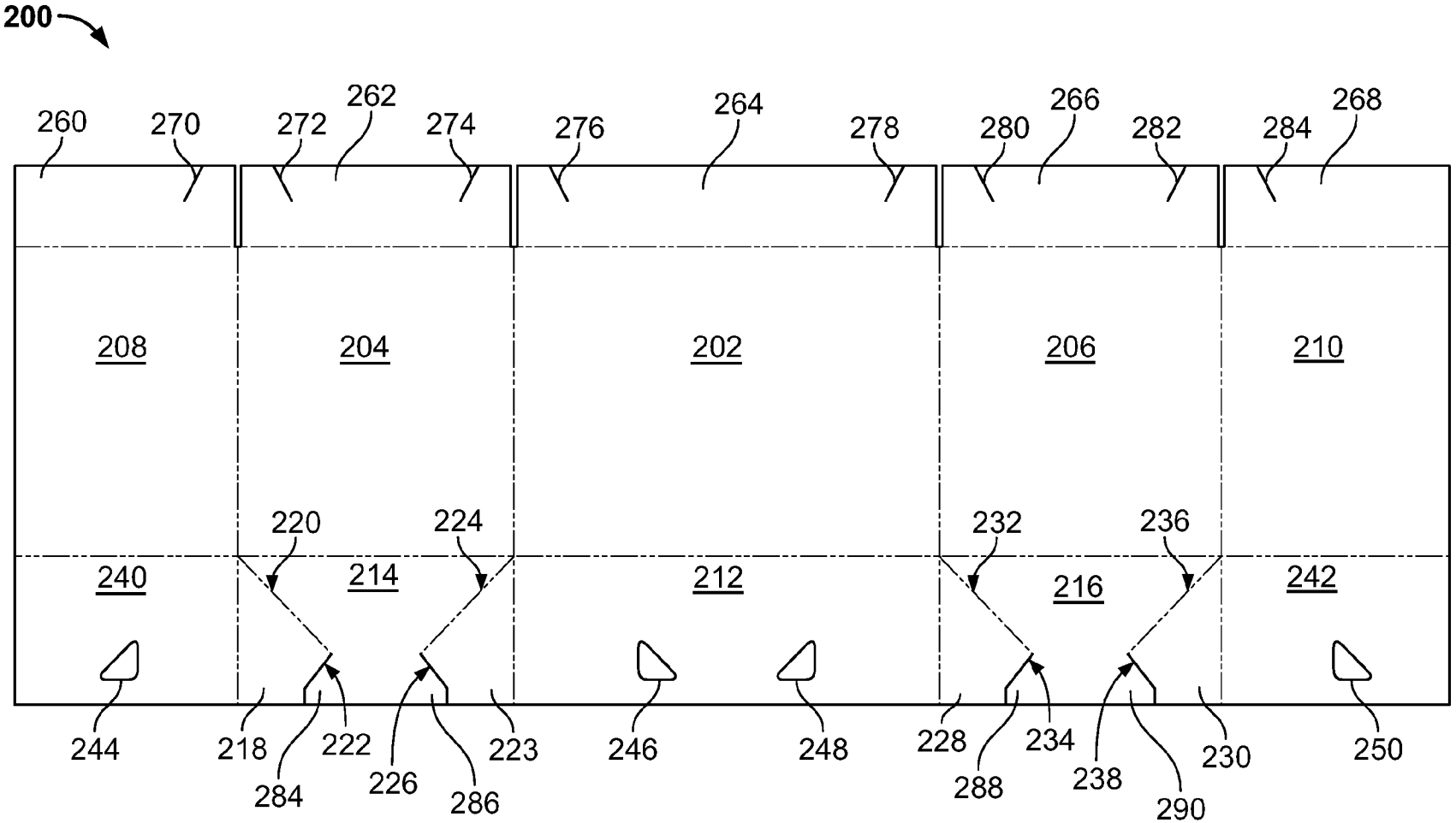
FIG. 6 is a plan view for a blank for a bulk bin, according to the principles of the present invention, which is used to form a four-sided bulk bin, according to an alternative embodiment of the invention.

For example, a blank for a four-sided bulk bin is shown in FIG. 6. Blank 200 includes long side panel 202; short side panels 204, 206; and half side panels 208, 210 which are overlapped to form a composite long side panel, opposite long side panel 202 upon articulation and gluing of the bulk bin blank 200. Blank 200 also includes long bottom panel 212; short bottom panels 214, 215 with tabs 284, 286, 288, 290; half bottom panels 240, 242; connector panels 218 (defined by fold 220 and cut 222), 223 (defined by fold 224 and cut 226), 228 (defined by fold 232 and cut 234) and 230 (defined by fold 236 and cut 238); tab receiving openings 244, 246, 248 and 250. Blank 200 also includes top reinforcing flaps 260, 262, 264, 266 and 268, with notches 270, 272, 274, 276, 278, 280, 282 and 284.

To form a bulk bin from blank 200, the blank is folded upon itself so that half side panels 208, 210 are slightly overlapped and glued to each other. Similarly, half bottom panels 240, 242 are overlapped and glued to one another. To help reinforce the top edges of the side panels, top reinforcing flaps 260, 262, 264, 266 and 268 are folded perpendicular to the side panels, and the notches of adjacent top reinforcing flaps are interdigitated, so that the top reinforcing flaps interlock. Formation of the bottom is accomplished by first folding long bottom panel 212, and the composite bottom panel formed by half bottom panels 240, 242 to positions perpendicular to the side panels. This action causes the connector panels to be pivoted about the respective fold lines connecting them to their respective adjacent bottom panels. Finally, bottom panels 214 and 216 are folded down, and tabs 284, 286, 288 and 290 are received by openings 244, 246, 248 and 250, respectively.

Figure 7:
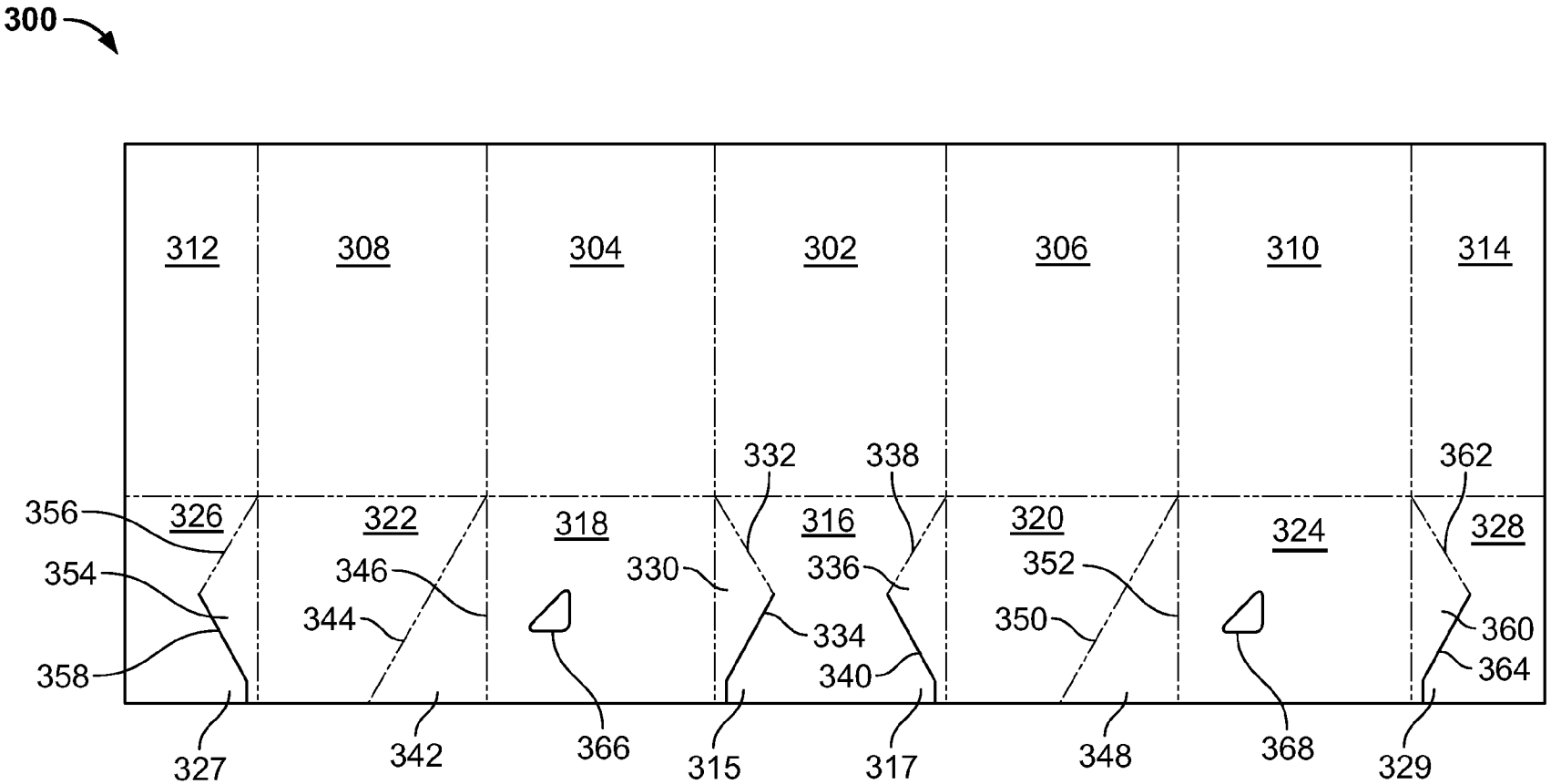
FIG. 7 is a plan view for a blank for a bulk bin, according to the principles of the present invention, which is used to form a six-sided bulk bin, according to an alternative embodiment of the invention.

FIG. 7 illustrates a blank for forming a six-sided (hexagonal) bulk bin. Upon articulation and folding, blank 300, as illustrated, will form a regular hexagonal bulk bin, although in alternative embodiments, one or more opposing pairs of side panels may be longer than others, to form an elongated configuration. Blank 300 includes side panels 302, 304, 306, 308, 310 and half side panels 312, 314; bottom panels 316 (with tabs 315, 317), 318, 320, 322, 324, and half bottom panels 326 (with tab 327), 328 (with tab 329); connector panels 330 (defined by fold 332 and cut 334), 336 (defined by fold 338 and cut 340), 342 (defined by folds 344, 346), 348 (defined by folds 350, 352), 354 (defined by fold 356 and cut 358), and 360 (defined by fold 362 and cut 364); and tab openings 366, 368.

After folding blank 300 and gluing panels 326 and 328 together (with a slight overlap), to form the bottom, first bottom panels 332, 320 are folded perpendicular to the side panels, with bottom panels 318, 324, following (with their respective adjacent connector panels swinging to positions sandwiched between the bottom panels). Finally bottom panels 316 and the composite bottom panel formed from panels 326, 328 are folded down, so that tabs 327 is received by aperture 366 while tab 317 is received by aperture 368.

Figure 8:
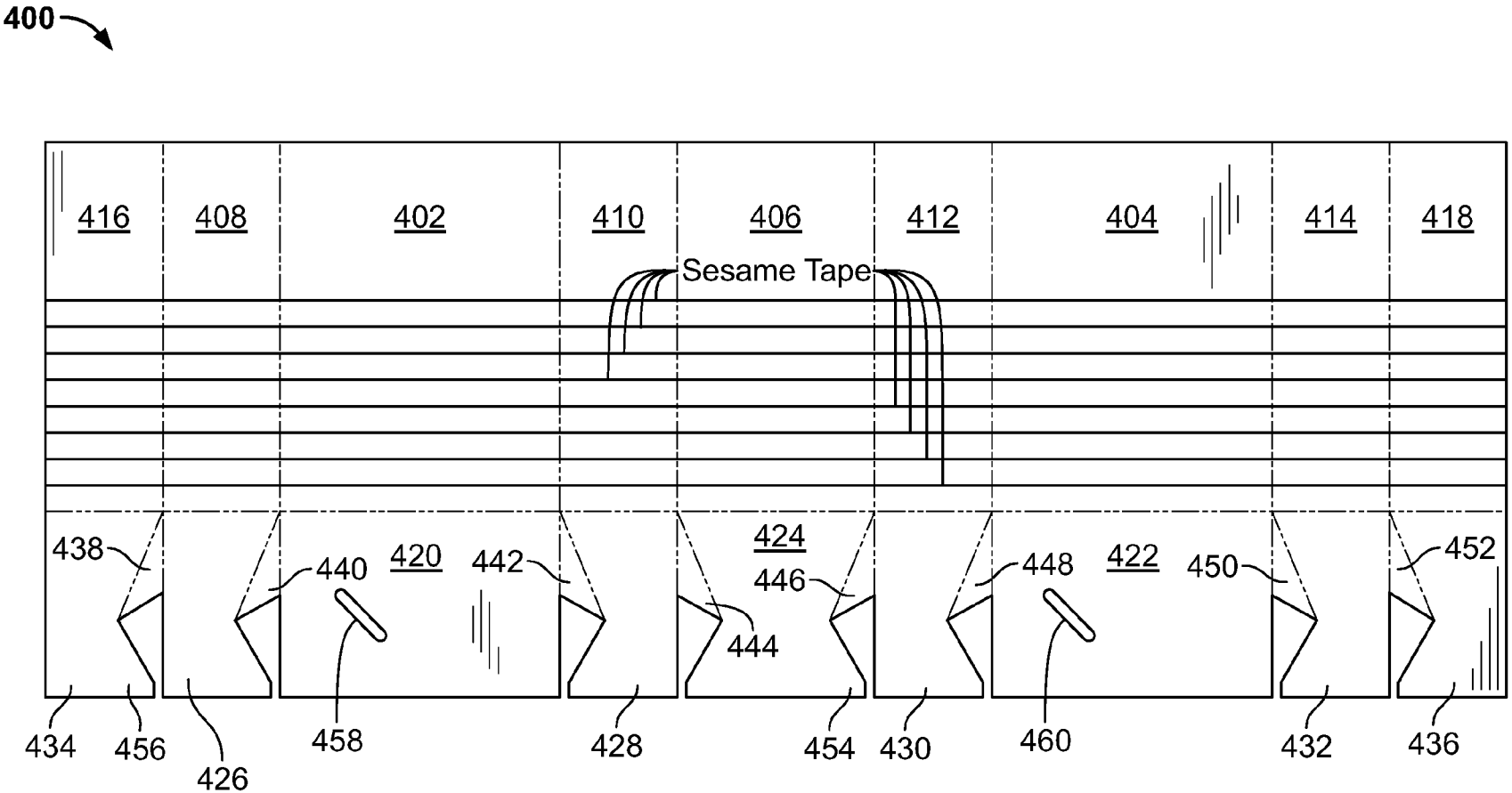
FIG. 8 is a plan view for a blank for a bulk bin, according to the principles of the present invention, which is used to form an eight-sided bulk bin, according to an alternative embodiment of the invention.

Blank 400, shown in FIG. 8, is for forming an alternative construction of an eight-sided bulk bin. Blank 400 includes long side panels 402, 404; short side panel 406; diagonal corner panels 408, 410, 412, 414; and half side panels 416 and 418 which, when overlapped and glued together, form a composite short side panel, which will be positioned opposite short side panel 406, upon full articulation of the resultant bin. Blank 400 also includes long bottom panels 420 (with slot 458), 422 (with slot 460); short bottom panel 424; diagonal bottom panels 426, 428, 430, and 432; and half bottom panels 434 and 436, which similarly when overlapped and glued together form a composite short bottom panel which will be positioned opposite short bottom panel 424, upon articulation of the bin. Blank 400 further includes connector panels 438, 440, 442, 444, 446, 448, 450 and 452, which are connected by pairs of converging fold lines to their respective adjacent bottom panels. Unlike the embodiment of FIGS. 1-5, there are no clearance flaps. Articulation and folding of the various bottom and connector panels is substantially identical to that employed in the articulation and folding of the bottom and connector panels in the embodiment of FIGS. 1-5. Blank 400 may further include reinforcement tapes, known as "Sesame Tape" to those of ordinary skill in the art of designing and fabricating bulk bins from corrugated paperboard material, for providing additional resistance to bulging for especially large loads.

Figure 9:
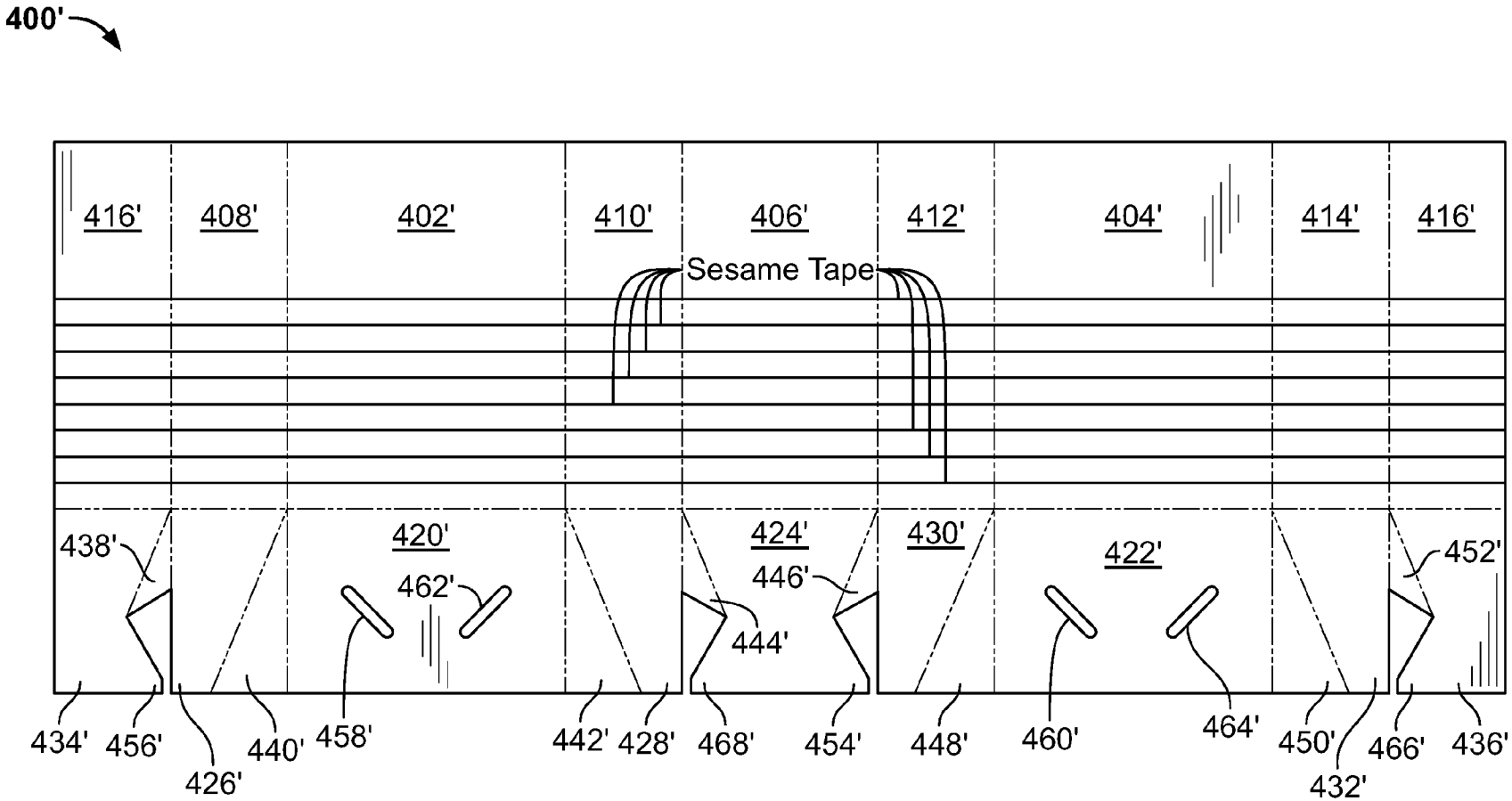
FIG. 9 is a plan view for a blank for a bulk bin, according to the principles of the present invention, which is used to form an eight-sided bulk bin, according to an alternative embodiment of the invention.

FIG. 9 illustrates blank 400' which is substantially identical to blank 400, and so has similarly situated panels indicated by like reference numerals, but augmented by primes (').Blank 400' differs principally from blank 400 in that connector panels 440', 442', 448' and 450' are substantially enlarged and extend to the peripheral edge of the blank; and that instead of just one tab receiving slot in each of bottom panels 420' and 422', there are two. As such, blank 400' includes additional slots 462' and 464' and tabs 466' and 468'. Aside from those differences, articulation and folding of the various bottom and connector panels is substantially identical to that employed in the articulation and folding of the bottom and connector panels in the embodiment of FIGS. 1-5. Blank 400' also may include reinforcing "Sesame Tape", if desired, as in the embodiment of FIG. 8.

The foregoing description and drawings merely explain and illustrate the invention, and the invention is not so limited as those skilled in the art who have the disclosure before them will be able to make modifications and variations therein without departing from the scope of the invention.

What is claimed is:

1. A collapsible bulk bin, fabricated from a foldable material, comprising:

a plurality of side walls, arranged in the form of a tube and connected to one another along a plurality of parallel-extending fold lines;

a plurality of bottom panels extending from bottom edge regions of the side walls, with a fold line disposed between each bottom panel and its respective side wall, the bottom panels are connected to one another along a plurality of fold lines extending along side edge regions of the bottom panels, each bottom panel extending a distance from a respective bottom edge region to a free edge of the plurality of bottom panels;

each bottom panel being pivotable between an unfolded position substantially parallel to its corresponding side wall, and a folded position substantially perpendicular to its corresponding side wall;

a plurality of connector panels defined by a plurality of lines of weakness, the plurality of connector panels extending the same distance as each bottom panel from a bottom edge region of a side wall to the free edge of the plurality of bottom panels, each connector panel defined within a side edge region between adjacent ones of the plurality of bottom panels by a line of the plurality of lines of weakness, each line of the plurality of lines of weakness includes at least one fold line and at least one line of separation;

each connector panel being pivotable between an unfolded position disposed substantially parallel to and coplanar with one of its corresponding adjacent bottom panels, to a folded position disposed in sandwiched orientation between its adjacent bottom panels, each connector panel being operably configured such that upon folding of one of its adjacent bottom panels from its unfolded position to its folded position, the connector panel prompts the other of the adjacent bottom panels from its unfolded position to its folded position, the connector panels providing slotless interconnections between adjacent bottom panels, the slotless interconnections extending from lower end regions of the plurality of parallel-extending fold lines which extend between adjacent ones of the side walls, so as to bridge gaps, which may otherwise be formed between adjacent ones of the bottom panels, upon articulation of the bottom panels into their folded positions, toward precluding the creation of gaps at corner regions of a bottom area of the collapsible bulk bin which may prompt failure of the collapsible bulk bin, subsequent to loading thereof.

2. The collapsible bulk bin according to claim 1, wherein each connector panel has a substantially triangular configuration.

3. The collapsible bulk bin according to claim 1, further comprising:

an aperture disposed in at least one of the bottom panels, operably configured to interlockingly receive a corner of another of the bottom panels, when the bottom panels have been pivoted to their folded positions, for releasably holding the bottom panels in their respective folded positions.

4. The collapsible bulk bin according to claim 1, wherein the bulk bin has one of four, six or eight side walls.

5. The collapsible bulk bin according to claim 1, wherein two of the bottom panels, disposed opposite one another on the bulk bin, are substantially rectangular, and the remaining bottom panels are substantially non-rectangular.

6. The collapsible bulk bin according to claim 1, wherein the bulk bin is fabricated from at least one of paper, paperboard, corrugated paperboard.

7. The collapsible bulk bin according to claim 1, wherein the bulk bin is fabricated from a blank formed from a single sheet of foldable material.

8. A blank for forming a collapsible bulk bin, comprising:

a substantially rectangular sheet fabricated from a foldable material;

a plurality of side wall panels formed therein and separated from one another by a plurality of parallel-extending fold lines, the side wall panels disposed at opposite ends of the sheet having free edges;

a plurality of bottom panels extending from bottom edge regions of the side wall panels, with a fold line disposed between each bottom panel and its respective side wall panel, the bottom panels disposed at opposite ends of the sheet having free edges, the bottom panels are connected to one another along a plurality of fold lines extending along side edge regions of the bottom panels, each bottom panel extending a distance from a respective bottom edge region to a free edge of the blank;

a plurality of connector panels defined by a plurality of lines of weakness, the plurality of connector panels extending the same distance as each bottom panel from a bottom edge region of a side wall to the free edge of the blank, each connector panel being defined within a side edge region between adjacent ones of the plurality of bottom panels by a line of the plurality of lines of weakness, each line of the plurality of lines of weakness includes at least one fold line and at least one line of separation;

the side wall panels disposed at opposite ends of the sheet being operably configured to be overlapped to form a composite side wall panel, upon folding of the sheet upon itself to form a tube;

the bottom panels disposed at opposite ends of the sheet being operably configured to be overlapped to form a composite side wall panel, upon folding of the sheet upon itself to form a tube, the connector panels providing slotless interconnections between adjacent bottom panels, the slotless interconnections extending from lower end regions of the plurality of parallel-extending fold lines which extend between adjacent ones of the side walls so as to bridge gaps, which may otherwise be formed between adjacent ones of the bottom panels, upon articulation of the bottom panels into their folded positions, toward precluding the creation of gaps at corner regions of a bottom area of the collapsible bulk bin which may prompt failure of the collapsible bulk bin, subsequent to loading thereof.

9. The blank according to claim 8, wherein each connector panel has a substantially triangular configuration.

10. The blank according to claim 8, further comprising:

an aperture disposed in at least one of the bottom panels, for interlockingly receiving a corner of another of the bottom panels, when the blank is articulated into a deployed bulk bin configuration.

11. The blank according to claim 8, wherein two of the bottom panels are substantially rectangular, and the remaining bottom panels are substantially non-rectangular.

12. The blank according to claim 8, wherein the blank is fabricated from at least one of paper, paperboard, corrugated paperboard.

13. The blank according to claim 8, wherein the blank is preferably formed from a single sheet of foldable material.

14. The blank according to claim 8, further comprising a plurality of top reinforcement panels emanating from top edges of the side wail panels.

15. The blank according to claim 14, wherein the top reinforcement panels are provided with slots for enabling the top reinforcement panels to be interdigitated, for providing resistance to outward bulging of the side wall panels, when the bulk bin formed from the blank is loaded.

16. The collapsible bulk bin according to claim 1 further comprising a plurality of top reinforcement panels emanating from top edges of the side wall panels.

17. The collapsible bulk bin according to claim 16, wherein the top reinforcement panels are provided with slots for enabling the top reinforcement panels to be interdigitated, for providing resistance to outward bulging of the side wall panels, when the bulk bin formed from the blank is loaded.

18. The collapsible bulk bin according to claim 1, wherein at least one of the plurality of connector panels comprises a first portion and a second portion, the second portion defining a clearance flap.

* * * * *